US007708004B2

(12) United States Patent
Moss et al.

(10) Patent No.: US 7,708,004 B2
(45) Date of Patent: May 4, 2010

(54) BOW WITH ROTATABLE GRIP ASSEMBLY

(76) Inventors: Kenneth R. Moss, 2311 Pleasant Plains Church Rd., Whiteville, NC (US) 28472; James F. Stevens, 467 Antioch Church Rd., Whiteville, NC (US) 28472

( * ) Notice: Subject to any disclaimer, the term of this patent is extended or adjusted under 35 U.S.C. 154(b) by 347 days.

(21) Appl. No.: 11/708,901

(22) Filed: Feb. 21, 2007

(65) Prior Publication Data

US 2007/0193571 A1 Aug. 23, 2007

Related U.S. Application Data

(60) Provisional application No. 60/776,606, filed on Feb. 23, 2006.

(51) Int. Cl.
*F41B 5/00* (2006.01)

(52) U.S. Cl. ..... 124/88

(58) Field of Classification Search ..... 124/23.1, 124/86, 88

See application file for complete search history.

(56) References Cited

U.S. PATENT DOCUMENTS 2,854,965 A 10/1958 Eberbach
3,397,685 A * 8/1968 Walker ..... 124/88
3,538,902 A * 11/1970 Fowkes ..... 124/88
3,599,621 A 8/1971 Scrobell
4,054,121 A 10/1977 Hoyt, Jr.
4,076,005 A 2/1978 Hill
4,091,790 A 5/1978 Hoyt, Jr.
4,252,100 A * 2/1981 Rickard ..... 124/23.1
4,343,286 A 8/1982 Thacker
4,457,287 A 7/1984 Babington
4,787,361 A 11/1988 Vyprachticky
4,957,093 A 9/1990 Hamlett
4,966,124 A 10/1990 Burling
5,349,937 A 9/1994 Burling
5,551,413 A 9/1996 Walk
5,651,354 A * 7/1997 La Haise, Sr. ..... 124/23.1

* cited by examiner

*Primary Examiner*—John Ricci
(74) *Attorney, Agent, or Firm*—P. Jeff Martin; The McGougan Law Firm, LLC

(57) ABSTRACT

An archery bow with a rotatable hand grip is disclosed. The archery bow includes a riser, an upper limb, a lower limb, compound cams, and a bowstring supported on the cams. The riser includes a hand grip section manufactured integrally therewith. The hand grip section includes an elongated, rigid shaft having a hand grip rotatably mounted thereto.

18 Claims, 7 Drawing Sheets

BOW WITH ROTATABLE GRIP ASSEMBLY

RELATED APPLICATIONS

This application claims the benefit of U.S. Provisional Application No. 60/776,606 filed on Feb. 23, 2006.

BACKGROUND OF THE INVENTION

1. Field of the Invention

The present invention relates generally to archery bows and, more particularly, to an improved archery bow comprised of a riser which includes an integral, rotatable grip assembly with locking mechanism adapted to eliminate heeling, toeing, and torquing of the bow when aiming and shooting an arrow.

2. Description of the Related Art

In the sport of archery, when employing conventional bows and arrows, several structural components and characteristics of the bows materially influence the accuracy of the archer as well as arrow speed. In order for an archer to aim and shoot accurately at a desired target, it is essential to avoid heeling, toeing, and torquing of the bow.

"Heeling" is defined as when an archer holds the bow below the midpoint, or when he exerts more pressure on the lower portion of his hand against the bow, the lower end of the bow bends more than the upper end, thereby causing the arrow to riser higher than desired. "Toeing" is the reverse, or when the archer holds the bow above the midpoint, or when he exerts more pressure on the upper portion of his hand against the bow, the upper end of the bow bends more than the lower end, thereby causing the arrow to travel lower than desired.

Attempts have been made to not only modify these components to improve arrow speed without sacrificing accuracy, but to also increase arrow speed while simultaneously improving accuracy. The following are examples of such attempts: hand grip fixedly mounted to limbs via a connector assembly to facilitate center flight of an arrow upon release from bow; decrease in the arm brace height, hand grip portions formed integral with risers so as to reduce torque from being applied to the bow through the riser; universally connected handles fixedly mounted in a forward relationship to handle riser via a frame assembly; complex cable and pulley arrangements; offset handle grip assemblies, and longitudinally-adjustable pistol grips.

Another structural characteristic which materially affects bow accuracy is the inherent torque which is generated during a shot. A first torque results from offset relation or misalignment of the arrow axis to the handle grip as the bowstring is drawn back toward its maximum deflection, thus resulting in a bow design having forces inherently imbalanced. This imbalance of force puts a torque on the archer's holding hand and creates a misaligned thrust on the arrow. A second torque results when an archer slightly twists the handle grip, while having the bowstring in a fully drawn position at the time of release of the arrow. This creates a misalignment which angles the bowstring away from its normal plane of travel. Thus, upon release of the arrow, the misaligned bowstring realigns during the string's forward thrust resulting in an unintended deviation in arrow's flight.

Early attempts at correcting the inherent torque problem have led to archery bows with pivotally-connected grip assembly installations. While these devices have helped to reduce torque generation during a bow shot, they have failed to eliminate or reduce torquing omnidirectionally to an optimum degree which would prevent an archer's accuracy to be impacted negatively. Further, these devices have neglected to design an archery bow incorporating an improved riser comprised of an integral grip assembly adapted to rotate relative to the riser's longitudinal axis in a friction-free manner. This improved riser is further adapted for quick, easy, and efficient mounting to conventional hunting bow limbs as an aftermarket accessory. The aftermarket accessory is mounted in a manner such that the hand grip component thereof resides posterior to the handle grip section of a conventional bow, thereby providing user with a greater draw length, and hence translating into an increase in arrow speed by approximately 35-45 feet per second. Moreover, these devices have failed to address the need for a quick-lock-and-release mechanism adapted to lock the rotatable handle grip in a fixed position once archer has the bowstring in a fully drawn position and taken aim.

Hence, there is a long felt need for both an archery bow comprised of an improved riser which includes an integral, rotatable grip assembly with locking mechanism adapted to eliminate heeling, toeing, and torquing of the bow when aiming and shooting an arrow, and for an improved riser of a substantially similar design adapted for quick, easy, and efficient mounting to conventional hunting bow limbs as an aftermarket accessory.

A search of the prior art did not disclose any patents that read directly on the claims of the instant invention; however, the following references were considered related.

U.S. Pat. No. 4,054,121, issued in the name of Hoyt, Jr.;
U.S. Pat. No. 4,457,287, issued in the name of Babington;
U.S. Pat. No. 4,966,124, issued in the name of Burling;
U.S. Pat. No. 5,349,937, issued in the name of Burling;
U.S. Pat. No. 5,551,413, issued in the name of Walk;
U.S. Pat. No. 4,957,093, issued in the name of Hamlett;
U.S. Pat. No. 4,076,005, issued in the name of Hill;
U.S. Pat. No. 4,091,790, issued in the name of Hoyt, Jr.;
U.S. Pat. No. 3,397,685, issued in the name of Walker;
U.S. Pat. No. 2,854,965, issued in the name of Eberbach;
U.S. Pat. No. 4,343,286, issued in the name of Thacker; and
U.S. Pat. No. 4,787,361, issued in the name of Vypracht-icky.

Website www.mathewsinc.com, published 2005, advertises hunting bows, particularly the Switchback XT and Switchback LD.

Website www.bowmanbows.com, published 2003, advertises the sale of archery equipment, particularly the Accu-Riser 2.

Website www.bowsports.com, published 2005, provides a comprehensive online archery equipment web shop.

Accordingly, there exists a need for an improved archery bow which allows an archer to virtually eliminate heeling, toeing, and torquing of the bow when aiming and shooting an arrow at a desired target, thereby materially enhancing the archer's accuracy.

SUMMARY OF THE INVENTION

It is therefore an object of the present invention to provide an improved archery bow adapted to eliminate heeling, toeing, and torquing of the bow when aiming and shooting an arrow.

It is another object of the present invention to provide an aftermarket accessory adapted for removable attachment to a conventional hunting bow which is configured to increase arrow speed.

It is a feature of the present invention to provide an improved archery bow which allows the user thereof to enjoy a substantially high degree of bow shooting accuracy.

It is another object of the present invention to provide an improved archery bow constructed of a lightweight, rigid material.

It is another object of the present invention to provide an improved archery bow having a rotatable hand grip adapted to rotate in a friction-free manner.

It is another object of the present invention to provide an improved archery bow having a rotatable hand grip which incorporates a proximal locking mechanism adapted to both quickly lock the rotatable handle grip to a locked position at full bowstring draw, and release the handle grip to an unlocked, free-spinning position.

It is another object of the present invention to provide a rotatable grip assembly adapted for removable attachment to an archery bow as an aftermarket accessory.

Briefly described according to one embodiment of the present invention, an archery bow with rotatable hand grip, hereinafter improved archery bow, is provided. The improved archery bow is adapted to prevent the heeling, toeing, and torquing effects of a conventional archery bow or hunting bow when archer aims and shoots an arrow at a desired target, thereby resulting in archer having a substantially high degree of bow shooting accuracy.

The improved archery bow comprises a riser, an upper limb and a lower limb, compound cams or pulleys rotatably mounted to free ends of limbs, and a bowstring supported on the cams or pulleys. The upper and lower limbs are secured to opposing ends of riser. A clearance bar is provided which is secured to the riser in any suitable fashion. The riser includes a hand grip section manufactured integrally therewith. Hand grip section defines an elongated, rigid shaft.

A rotatable hand grip is provided and is rotatably mounted to rigid shaft. The rotatable hand grip is adapted to rotate in a friction-free manner about a longitudinal axis of rigid shaft. In order to facilitate friction-free rotation by rotatable hand grip about a longitudinal axis of rigid shaft, an antifriction rotation assembly is disclosed.

The antifriction rotation assembly comprises components, elements, and hardware adapted to facilitate mechanized, frictionless rotation by hand grip about a longitudinal axis of rigid shaft.

A locking mechanism is provided which is adapted to quickly lock the rotatable handle grip in a fixed position once archer has the bowstring in a fully drawn position and taken aim, and is further adapted to allow hand grip to be quickly released from a locked position, thereby returning handle grip to a free-spinning mode after shooting arrow. Rotatable hand grip is enveloped with a sufficiently flexible, shape-memory material adapted to resume its original shape if compressed. The shape-memory material enveloping rotatable hand grip is adapted to prevent heeling and toeing of the bow when archer aims and shoots an arrow at a desired target. More specifically, the counterproductive pressure exertions applied by an archer resulting in the earlier described "heeling" or "toeing" effect are absorbed or consumed by the shape-memory material which is afforded by its pliable composition in a manner so as to maintain bow's proper vertical alignment about the bow midpoint when aiming and shooting an arrow.

The improved archery bow further comprises an arrow rest component mounted to riser via an arrow rest bracket. The arrow rest bracket is secured to riser by fasteners. It is envisioned that improved archery bow may include a sight element mounted to riser via a sight element bracket. The sight element bracket is secured to riser by fasteners.

The improved archery bow is constructed of a lightweight, rigid material, wherein fabrication material is selected from the group which includes metal, plastic, wood, or composites thereof.

An alternate embodiment of the present invention is provided which comprises a rotatable grip assembly adapted for removable attachment to an archery bow or "hunting bow" as an aftermarket accessory. The rotatable grip assembly comprises a rigid shaft defining an upper end opposing a lower end. A pair of mounting brackets is provided for securely affixing shaft to riser. A first mounting bracket is molded integral to the upper end of shaft, and a second mounting bracket is molded integral to the lower end of shaft. Each mounting bracket is secured to riser by fasteners. The shaft is adapted to be mounted directly rearward to handle grip section so as to reside in parallel alignment and in a same geometric longitudinal plane therewith. Once properly mounted to riser, the antifriction rotation assembly is configured to prevent torquing.

The alternate embodiment of the present invention further comprises a hand grip which is rotatably mounted to shaft. The hand grip is adapted to rotate in a friction-free manner about a longitudinal axis of shaft via an antifriction rotation assembly. The hand grip includes a contoured rear portion defined as a palm recess to facilitate grip. The hand grip is enveloped around the antifriction rotation assembly.

The antifriction rotation assembly defined by the alternate embodiment is provided with a locking mechanism adapted to quickly lock the rotatable handle grip in a fixed position once archer has the bowstring in a fully drawn position and taken aim, and is further adapted to be quickly released from a locked position, thereby returning handle grip to a free-spinning mode.

The rotatable grip assembly, as defined by the alternate embodiment, is envisioned to be commercially available and sold as an aftermarket accessory for commercially-available archery bows. The rotatable grip assembly 200, as an aftermarket accessory, is intended to be sold as a kit.

In accordance with another embodiment, a rotatable grip assembly comprises a rigid shaft having a hand grip rotatably mounted thereto. Auxiliary brackets are provided to securely mount shaft to a primary mounting bracket. The primary mounting bracket is provided for securely affixing shaft to the riser. A C-shaped mounting bracket is adapted to secure the primary mounting bracket to the riser via frictional interference.

The use of the present invention allows a bow shooter to eliminate heeling, toeing, and torquing of an archery bow when aiming and shooting an arrow in a manner which is quick, easy, and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
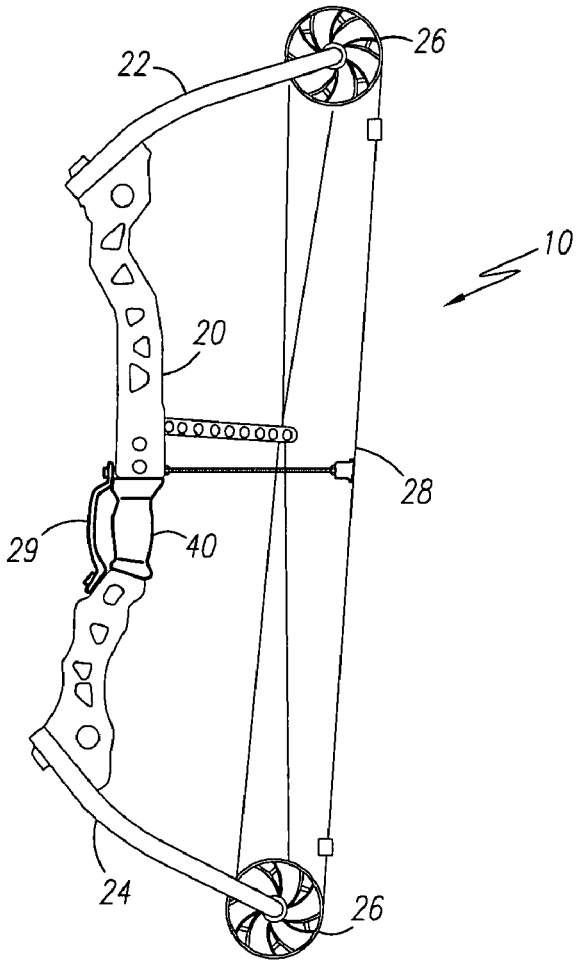
FIG. 1 is a perspective view of a bow with rotatable grip assembly, according to the preferred embodiment of the present invention.
Figure 2:
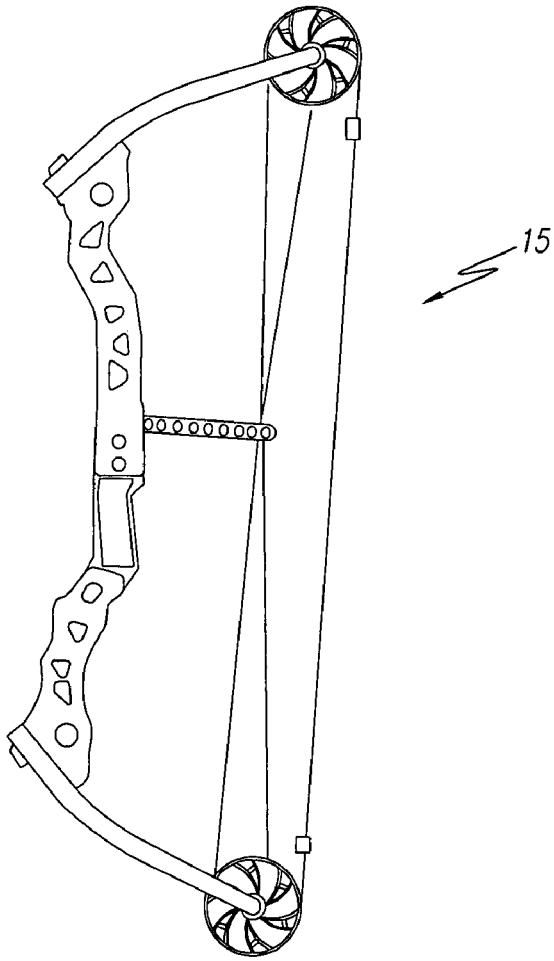
FIG. 2 is a perspective view of a standard archery or hunting bow.
Figure 3:
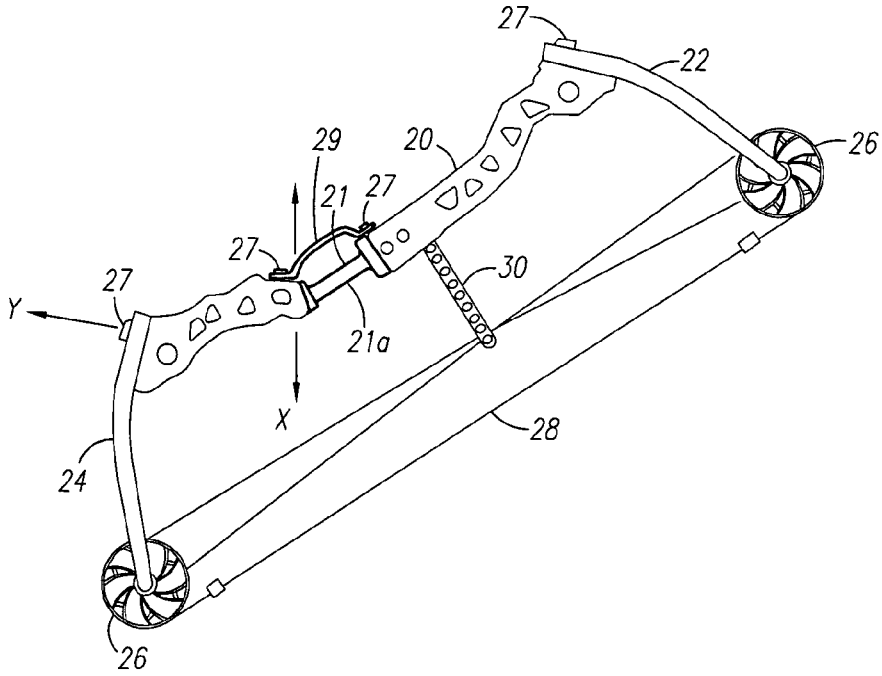
FIG. 3 is a perspective view of the present invention illustrating particularly the hand grip section, according to the preferred embodiment of the present invention.
Figure 4:
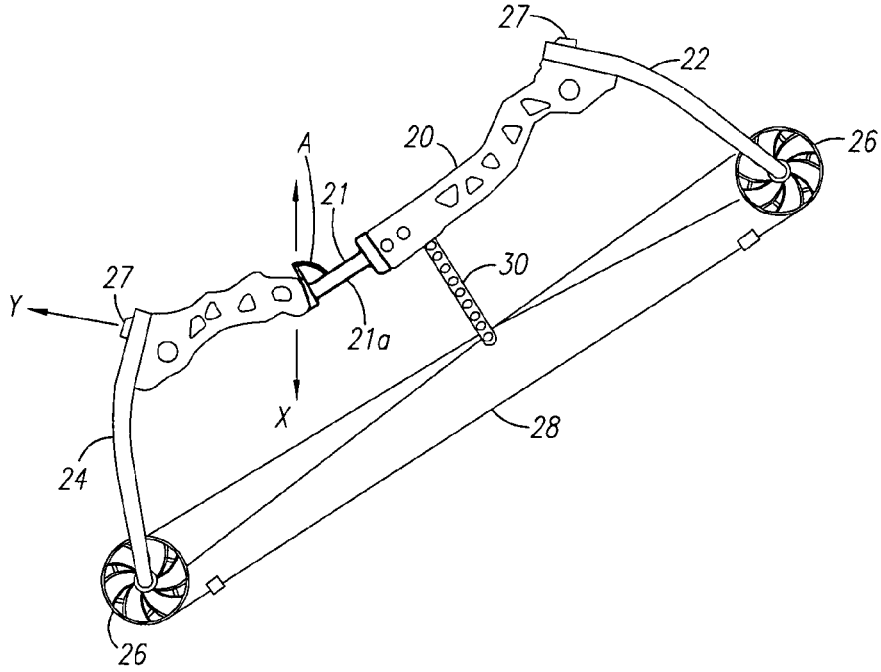
FIG. 4 is a perspective view of the present invention illustrating the angular orientation of rigid shaft with respect to riser, shown without riser brace, according to the preferred embodiment of the present invention.

Referring now to FIGS. 1-11, an archery bow with rotatable hand grip 10 is shown, hereinafter referred to as improved archery bow 10, according to the preferred embodiment of the present invention. The improved archery bow 10 is adapted to prevent the heeling, toeing, and torquing effects of a conventional archery bow 15 or hunting bow when archer aims and shoots an arrow (not shown) at a desired target, thereby resulting in archer having a substantially high degree of bow shooting accuracy. For purposes of this description, the term archery bow 15 or hunting bow is intended to include, but not to be limited to longbows, recurve bows, compound bows, compound longbows, and recurve longbows.

The improved archery bow 10 comprises a riser 20, an upper limb 22 and a lower limb 24, compound cams 26 or pulleys rotatably mounted to free ends of limbs 22, 24, and a bowstring 28 supported on the cams 26 or pulleys. The upper and lower limbs 22, 24 are secured to opposing ends of riser 20 by fasteners 27. A clearance bar 30 is provided which is secured to the riser 20 in any suitable fashion. The riser 20 includes a hand grip section 21 manufactured integrally therewith. Hand grip section 21 defines an elongated, rigid shaft 21*a* molded so as to form an acute angle, indicated as "A", with respect to X-axis and Y-axis extending through riser 20 in FIG. 3. Hand grip section 21 has an angular measure of approximately 60°.

A riser brace 29 is mounted to a frontal sidewall of riser 20 via fasteners 27, wherein riser brace 29 is apposition to hand grip section 21. The riser brace 29 imparts added structural support to riser 20. Alternatively, it is envisioned that riser brace 29 is integrally molded to riser 20 during the riser molding process.

A rotatable hand grip 40 is provided and is rotatably mounted to rigid shaft 21*a*. The rotatable hand grip 40 is adapted to rotate in a friction-free manner about a longitudinal axis of rigid shaft 21*a*. The rotatable hand grip 40 is formed of two halves 42, 43 which are fastened together by fasteners 266 or any other suitable coupling means in a manner so as to effectively encase longitudinally the rigid shaft 21*a*. The two halves 42, 43 are constructed of a lightweight, rigid material including metal, metallic-plastic composite, plastic, or wood.

Figure 7:
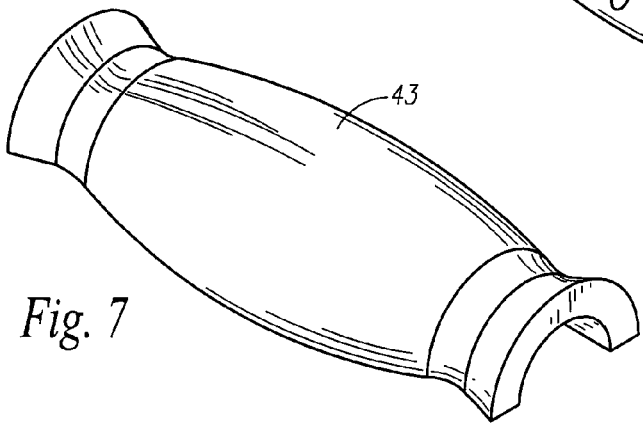
Figure 7A:
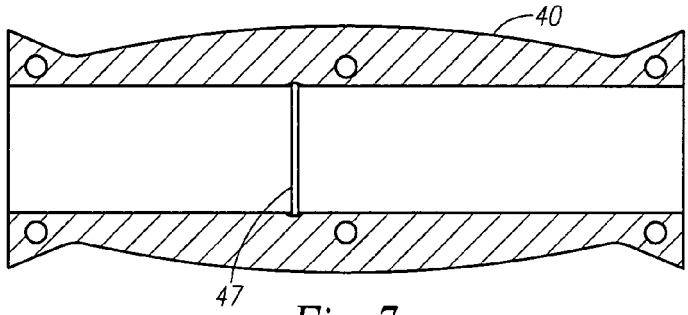
FIG. 7*a* is a cross-sectional view of the rotatable hand grip showing the O-ring, according to the preferred embodiment of the present invention.
Figure 8:
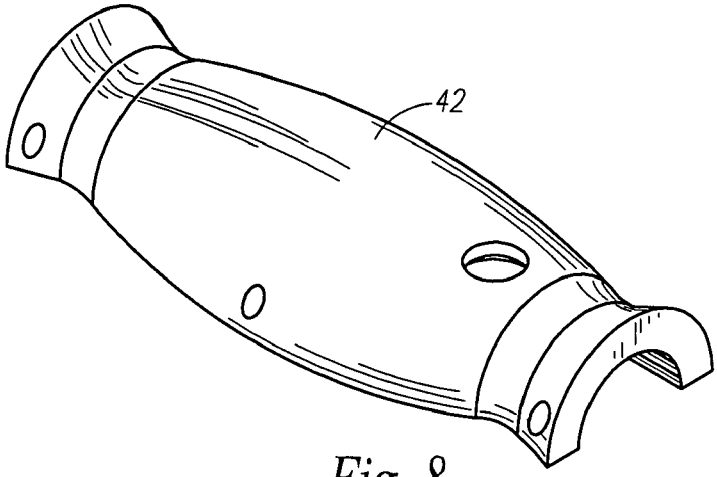
FIG. 8 is a perspective view of a female half portion forming rotatable hand grip, according to the preferred embodiment of the present invention.
Figure 9:
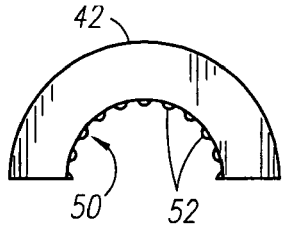
FIG. 9 is a frontal side elevational view of the rotatable hand grip female half portion showing the antifriction rotation assembly, according to the preferred embodiment of the present invention.
Figure 10:
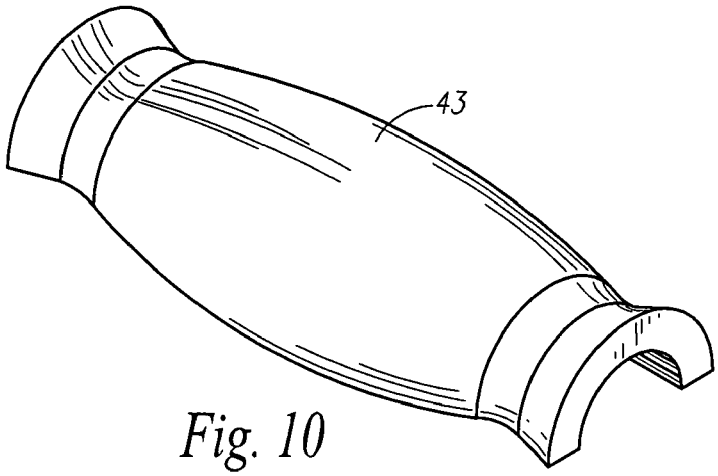
FIG. 10 is a perspective view of a male half portion forming rotatable hand grip, according to the preferred embodiment of the present invention.
Figure 11:
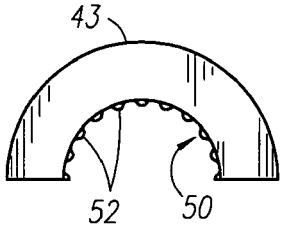
FIG. 11 is a frontal side elevational view of the rotatable hand grip male half portion showing the antifriction rotation assembly.

In order to prevent vertical reciprocation or up-and-down movement by rotatable hand grip 40 about longitudinal axis of rigid shaft 21*a*, at least one O-ring 47 is suitably disposed within interior sidewall of hand grip half 42 or 43 so as to be housed inside rotatable hand grip 40 upon the two halves 42, 43 being fastened together. O-ring 47 is shown in FIG. 7*a*.

In order to facilitate friction-free rotation by rotatable hand grip 40 about a longitudinal axis of rigid shaft 21*a*, an antifriction rotation assembly 50 is disclosed. The antifriction rotation assembly 50 affords important utility to the present invention as will be described in greater detail below.

The antifriction rotation assembly 50 comprises components, elements, and hardware adapted to facilitate mechanized, frictionless rotation by hand grip 40 about a longitudinal axis of rigid shaft 21*a*. It is envisioned that antifriction rotation assembly 50 comprises a plurality of bearings 52 rotatably disposed within dimpled seats spatially formed about an inner surface of hand grip halves 42, 43. Bearings 52 of hand grip halves 42, 43 bear against an outer circumferential surface 21*b* of rigid shaft 21*a*, thereby facilitating frictionless rotation between rotatable hand grip 40 and rigid shaft 21*a*.

Once rotatable hand grip 40 is properly mounted to rigid shaft 21*a* of riser 20, the antifriction rotation assembly 50 is adapted to prevent torquing. Torque generation materially affects bow accuracy. Torquing stems from and creates the following undesired effects: 1) offset relation or misalignment of the arrow axis to the handle grip as the bowstring is drawn back toward its maximum deflection, thus resulting in inherently imbalanced forces, wherein such imbalance of force puts a torque on the archer's holding hand and creates a misaligned thrust on the arrow; and 2) bowstring misalignment which is produced when an archer slightly twists the handle grip, while having the bowstring in a fully drawn position at the time of release of the arrow. This creates a misalignment which angles the bowstring away from its normal plane of travel. Thus, upon release of the arrow, the misaligned bowstring realigns during the string's forward thrust resulting in an unintended deviation in arrow's flight. The antifriction rotation assembly 50 is adapted to rotate clockwise and counterclockwise in a friction-free manner about the longitudinal axis of rigid shaft 21*a*, thereby preventing torque from being applied to the bow 10 and resulting in a substantially high degree of bow shooting accuracy.

Figure 5:
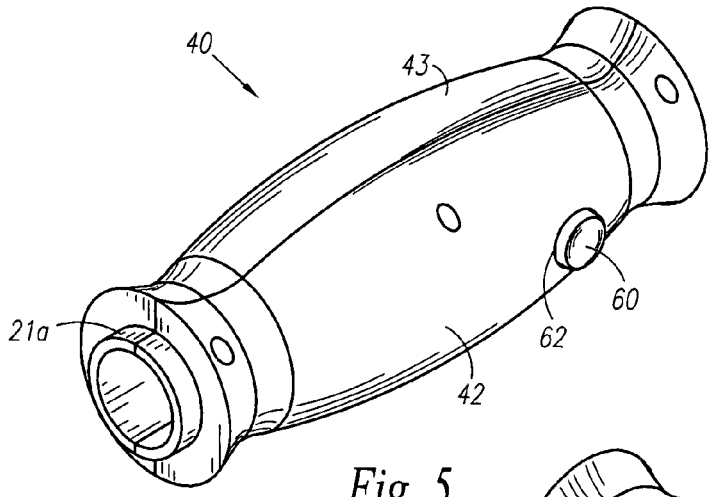
FIG. 5 is a perspective view of the rotatable hand grip, according to the preferred embodiment of the present invention.
Figure 6:
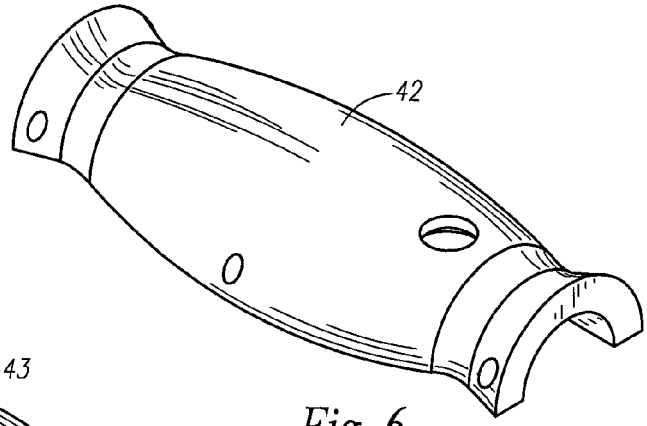
FIGS. 6 and 7 illustrate the two halves forming rotatable hand grip, according to the preferred embodiment of the present invention.
Figure 12:
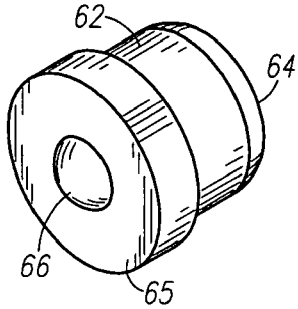
FIG. 12 is a perspective view of the plunger, according to the preferred embodiment of the present invention.

Referring now more specifically to FIGS. 5 and 12, a locking mechanism 60 is disclosed which is adapted to quickly lock the rotatable handle grip 40 in a fixed position once archer has the bowstring in a fully drawn position and taken aim. The locking mechanism 60 is further adapted to allow hand grip 40 to be quickly released from a locked position.

The locking mechanism 60 is comprised of a plunger 62 or spring-biased depressible button positioned proximally to an upper end of rotatable hand grip half 42 and extends through an aperture formed therein. The plunger 62 defines an upper end 64 opposing a lower end 65, wherein lower end 65 includes a centrally-disposed bulbous boss 66. Upon depression of plunger 62, the boss 66 frictionally engages an outer circumferential surface of rigid shaft 21*a*, thereby locking hand grip 40 in position via mechanical interference. Release of plunger 62 causes boss 66 to disengage contact with rigid shaft 21*a*, thereby allowing rotatable hand grip 40 to resume friction-free rotation about rigid shaft 21*a*.

Figure 13:
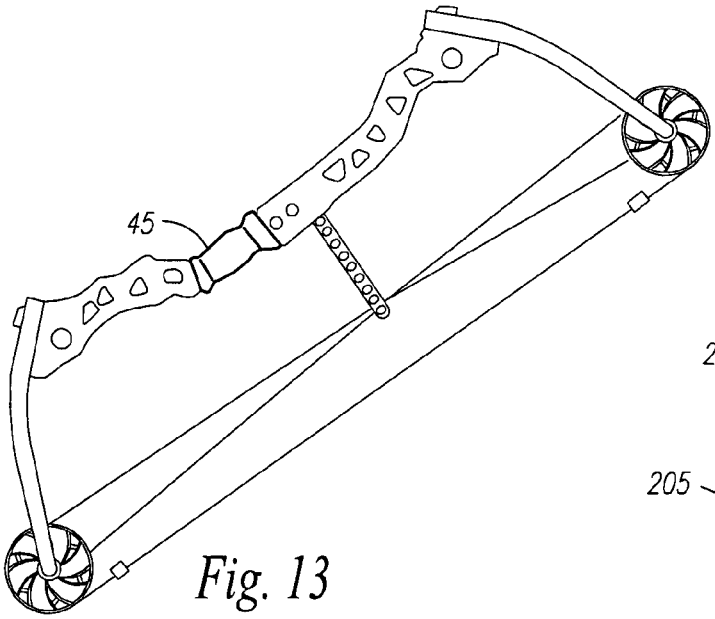
FIG. 13 is a perspective view of the present invention, wherein rotatable hand grip is shown enveloped with a shape-memory material.

Referring now to FIG. 13, rotatable hand grip 40 is enveloped with a sufficiently flexible, shape-memory material 45 adapted to resume its original shape if compressed. The shape-memory material 45 is enveloped around hand grip 40 via a molding process so as to completely encapsulate or enclose hand grip 40. Common molding processes for enveloping hand grip 40 include casting, injection or transfer molding, extrusion, thermoforming, blow molding, and rotational molding. It is envisioned that shape-memory material 45 is formed of a flexible, pliable plastic, rubber or elastomer, silicon, silicon rubber or siliconised polymer, or plastic polymer. Examples of acceptable materials utilized for constructing shape-memory material 45 include neoprene, polyvinyl chloride, thermosensitive siliconised polyvinyl chloride, polyurethane, polyethylene, and polyethylene terephthalate. The flexible, shape-memory material 45 utilized for enveloping hand grip 40 imparts additional important utility to the present invention. Rotatable hand grip 40 as described by the present invention prevents heeling and toeing of the bow 10 when archer aims and shoots an arrow at a desired target. More specifically, the counterproductive pressure exertions applied by an archer resulting in the earlier described "heeling" or "toeing" effect are absorbed or consumed by the shape-memory material 45 which is afforded by its pliable composition in a manner so as to maintain bow's 10 proper vertical alignment about the bow midpoint when aiming and shooting an arrow.

It is envisioned that rotatable hand grip 40 is molded to include a contoured rear portion defined as a palm recess to facilitate grip.

The improved archery bow 10 further comprises an arrow rest component mounted to riser 20 via an arrow rest bracket. The arrow rest bracket is secured to riser 20 by fasteners. It is envisioned that improved archery bow 10 may include a sight element mounted to riser 20 via a sight element bracket. The sight element bracket is secured to riser 20 by fasteners. It is further envisioned that improved archery bow 10 may include a string stop.

The improved archery bow 10 is constructed of a lightweight, rigid material, wherein fabrication material is selected from the group which includes metal, plastic, wood, or composites thereof.

Referring now to FIGS. 14-19, an alternate embodiment of the present invention is provided which comprises a rotatable grip assembly 200 adapted for removable attachment to an archery bow 205 or "hunting bow" as an aftermarket accessory. For purposes of this description, the term archery bow 205 or hunting bow is intended to include, but not to be limited to longbows, recurve bows, compound bows, compound longbows, and recurve longbows. The following archery and bowhunting companies manufacture and sell representative models or types of bows adapted to functionally accommodate the aftermarket accessory assembly disclosed herein as the alternate embodiment: Alpine Archery, Browning® Archery, Darton Bows, Oneida Eagle Bows, PSE Archery, Reflex Bows, Genesis Archery, HOYT®, CSS Bows, and Martin Archery. The archery companies provided hereinabove are merely illustrative examples, and as such are not intended to be limiting. Thus, it is envisioned that other companies who manufacture, distribute, and sell comparable archery bows not listed above are within the scope of this disclosure and consequently, such companies are anticipated to commercially trade bows also adapted to accommodate the aftermarket accessory assembly 200 defined by the alternate embodiment.

According to the alternate embodiment, an archery bow 205 comprises a riser 210, upper limb 212 and lower limb 214, compound cams 216 or pulleys rotatably mounted to free ends of limbs 212, 214, and a bowstring 218 supported on the cams 216 or pulleys. The upper and lower limbs 212, 214 are secured to opposing ends of riser 210 by fasteners 220. The riser 210 includes a handle grip section 211 molded integral or suitably mounted thereto. It is recognized that various bow models provide cams 216 which are eccentrically and rotatably mounted about the free ends of limbs 212, 214 via supports. It is further recognized that various bow models provide bifurcated upper and lower limbs between which cams or pulleys are rotatably mounted about the free ends thereof. A clearance bar 222 is provided which is secured to the riser 210 in any suitable fashion.

The archery bow 205 further comprises an arrow rest component mounted to riser 210 via an arrow rest bracket. The arrow rest bracket is secured to riser 210 by fasteners. It is envisioned that archery bow 205 may include a sight element mounted to riser 210 via a sight element bracket. The sight element bracket is secured to riser 210 by fasteners. It is further envisioned that archery bow 205 may include a string stop.

Figure 14:
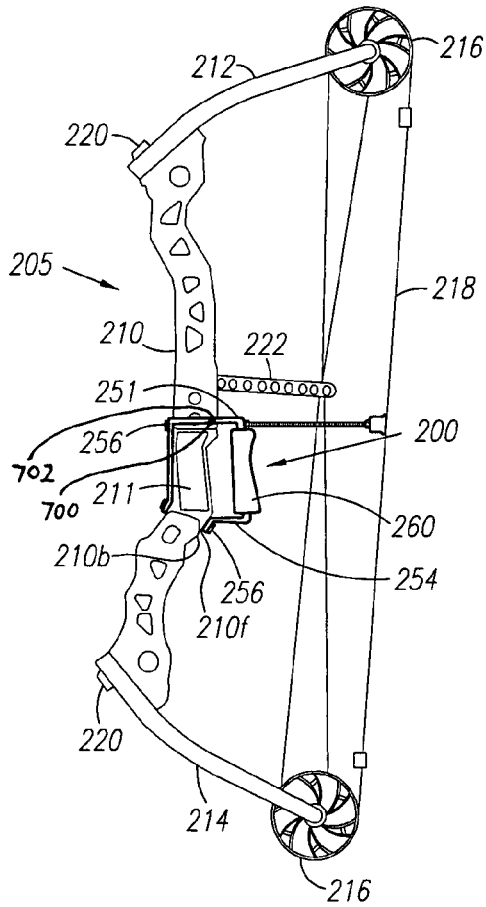
FIGS. 14 and 15 are perspective views of a first alternate embodiment each illustrating a hunting bow shown with a rotatable grip assembly removably attached thereto as an aftermarket accessory.
Figure 15:
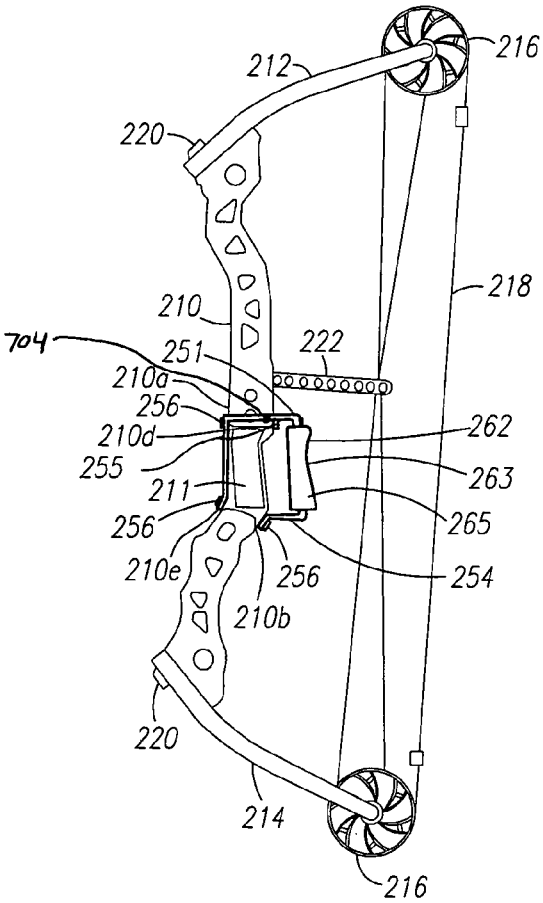

The rotatable grip assembly 200 comprises a rigid shaft 240 defining an upper end opposing a lower end. A pair of mounting brackets 250 is provided for securely affixing shaft to riser. A first mounting bracket 251, having a generally L-shaped configuration and an integral riser abutment shoulder 255, is mounted or molded integral to the upper end of shaft 240, and a second mounting bracket 254 having a generally L-shaped configuration is mounted or molded integral to the lower end of shaft 240. Each mounting bracket 251, 254 is secured to riser 210 by fasteners 256. More specifically, the first mounting bracket 251 includes an upper aperture 257 and a lower aperture 258 defined through a vertical arm 252 thereof. The first mounting bracket 251 is mounted to a front sidewall 210*a* of riser 210, along an upper end and a lower end of the handle grip section 211 thereof by fastener 256 being advanced through upper aperture 257 and lower aperture 258 of vertical arm 252, and wherein fastener 256 is further advanced through upper threaded aperture 210*d* defined through the front sidewall 210*a* of riser 210, and fastener 256 is advanced through lower threaded aperture 210*e* defined through the front sidewall 210*a* of riser 210 until tight. The second mounting bracket 254 includes an aperture 259*a* defined through a vertical arm 259 thereof. The second mounting bracket 254 is mounted to a rear sidewall 210*b* of riser 210, below handle grip section 211 by fastener 256 being advanced through aperture 259*a* of vertical arm 259 and through a threaded aperture 210*f* defined through the rear sidewall 210*b* of riser 210 until tight. The shaft 240 is adapted to be mounted directly rearward to handle grip section 211 so as to reside in parallel alignment and in a same geometric longitudinal plane therewith as illustrated in FIGS. 14 & 15.

An alignment means 700 is provided in order to allow for selective lateral adjustment of rotatable grip assembly 200, thereby facilitating optimum center alignment thereof. The alignment means 700 is defined as a male threaded bolt 702 or screw advanced through a female threaded hole 704 defined through first mounting bracket 251 along an upper portion thereof, and mechanically engaged against a lateral sidewall of riser 210. Clockwise rotation of male threaded bolt 702 facilitates rearward lateral movement of rotatable grip assembly 200 and counterclockwise rotation of male threaded bolt 702 facilitates forward lateral movement of rotatable grip assembly 200. The alignment means 700 is adjustable according to user desire or preference in order to obtain optimum center alignment of rotatable grip assembly 200.

The rotatable grip assembly further includes a hand grip 260 being rotatably mounted to shaft 240. The hand grip 260 is adapted to rotate in a friction-free manner about a longitudinal axis of shaft 240. The rotatable grip assembly 200 is mounted in a manner such that the hand grip 260 component thereof resides posterior to the handle grip section 211 of an archery bow 205, thereby providing user with a greater draw length (approximately 3 inches) from which a greater arrow-propulsion force is produced, and hence translating into an increase in arrow speed by approximately 35-45 feet per second. Consequently, greater arrow speed also generates greater arrow flight distance. The hand grip 260 will be further described later in greater detail.

Figure 16:
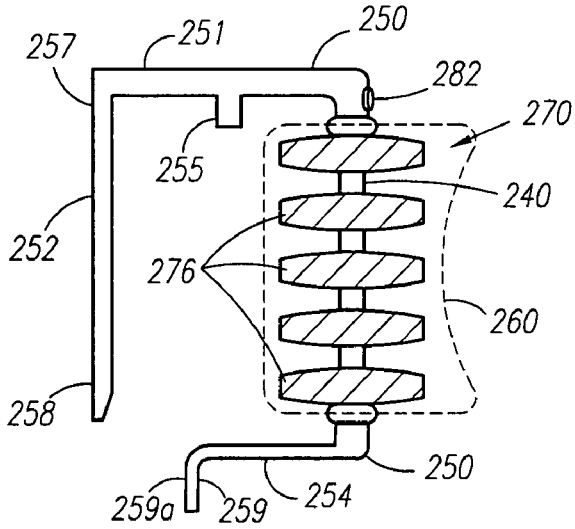
FIG. 16 is a side elevational view of the rotatable grip assembly according to the alternate embodiment illustrating the pair of mounting brackets, the hand grip, and the antifriction rotation assembly.
Figure 17:
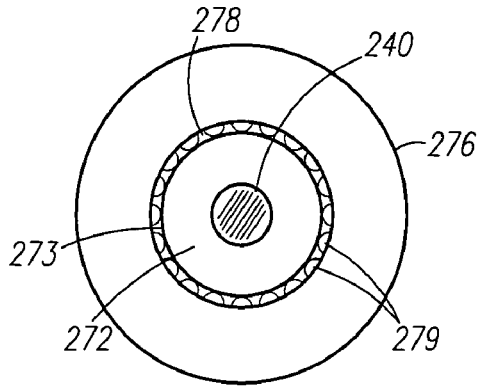
FIG. 17 is a bottom end view of the antifriction rotation assembly showing the bearings of each annular member bearing against the outer circumferential surface of each respective retaining ring.
Figure 19:
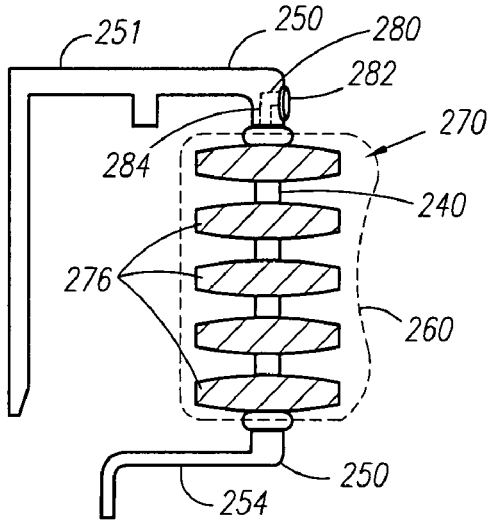
FIG. 19 is a side elevational view of the rotatable grip assembly, according to the alternate embodiment, illustrating the locking mechanism thereof.
Figure 20:
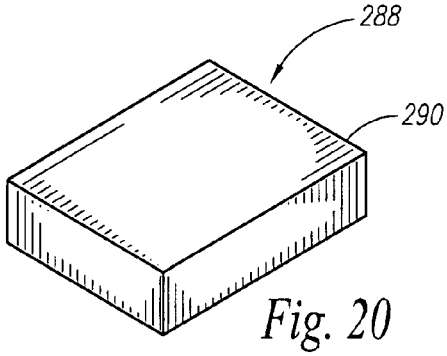
FIG. 20 is a perspective view of a kit, according to the first alternate embodiment of the present invention.

In order to facilitate friction-free rotation by hand grip 260 about a longitudinal axis of shaft 240, an antifriction rotation assembly 270 is provided, as shown in FIGS. 16, 17, and 19. The antifriction rotation assembly 270 affords important utility to the present invention as will be described in greater detail below. The antifriction rotation assembly 270 comprises a series of retaining rings 272 mounted in spaced, linear relation about an external circumferential surface of shaft 240. An equal number of annular members 276, each having an annular groove 278 housing a plurality of bearings 279, is rotatably disposed about an outer circumferential surface 273 of retaining rings 272 in a manner whereby bearings 279 of each annular member 276 bear against the outer circumferential surface 273 of each respective retaining ring 272, thereby facilitating frictionless rotation between annular members 276 and retaining rings 272. Once properly mounted to riser 210, the antifriction rotation assembly 270 is configured to prevent torquing. Torque generation materially affects bow accuracy. As stated earlier, torquing stems from and creates the following undesired effects: 1) offset relation or misalignment of the arrow axis to the handle grip as the bowstring is drawn back toward its maximum deflection, thus resulting in inherently imbalanced forces, wherein such imbalance of force puts a torque on the archer's holding hand and creates a misaligned thrust on the arrow; and 2) bowstring misalignment which is produced when an archer slightly twists the handle grip, while having the bowstring in a fully drawn position at the time of release of the arrow. This creates a misalignment which angles the bowstring away from its normal plane of travel. Thus, upon release of the arrow, the misaligned bowstring realigns during the string's forward thrust resulting in an unintended deviation in arrow's flight. The antifriction rotation assembly 270 is adapted to rotate clockwise and counterclockwise in a friction-free manner about the longitudinal axis of shaft 240, thereby preventing torque from being applied to the bow 205 and resulting in a substantially high degree of bow shooting accuracy.

The hand grip 260 includes a contoured rear portion 262 defined as a palm recess 263 to facilitate grip. The hand grip 260 is enveloped around the annular members 276 via a molding process so as to completely encapsulate or enclose the annular members 276 as well as the retaining rings 272 and shaft 240. Common molding processes for constructing hand grip 260 include casting, injection or transfer molding, extrusion, thermoforming, blow molding, and rotational molding. The hand grip 260 is preferably constructed of a sufficiently flexible, shape-memory material 265 adapted to resume its original shape if compressed, but other fabrication materials such as metallic or metallic-plastic composite or wood may be utilized. It is envisioned that hand grip 260 is formed of a flexible, pliable plastic, rubber or elastomer, silicon, silicon rubber or siliconised polymer, or plastic polymer. Examples of acceptable materials for constructing hand grip 260 include neoprene, polyvinyl chloride, thermosensitive siliconised polyvinyl chloride, polyurethane, polyethylene, and polyethylene terephthalate. The flexible, shape-memory material 265 utilized for constructing hand grip 260 imparts additional important utility to the present invention. The hand grip 260 as described by the present invention prevents heeling and toeing of the bow when archer aims and shoots an arrow at a desired target. More specifically, the counterproductive pressure exertions applied by an archer resulting in the earlier described "heeling" or "toeing" effect are absorbed or consumed by hand grip's 260 pliable composition in a manner so as to maintain bow's proper vertical alignment about the bow midpoint when aiming and shooting an arrow.

Figure 18:
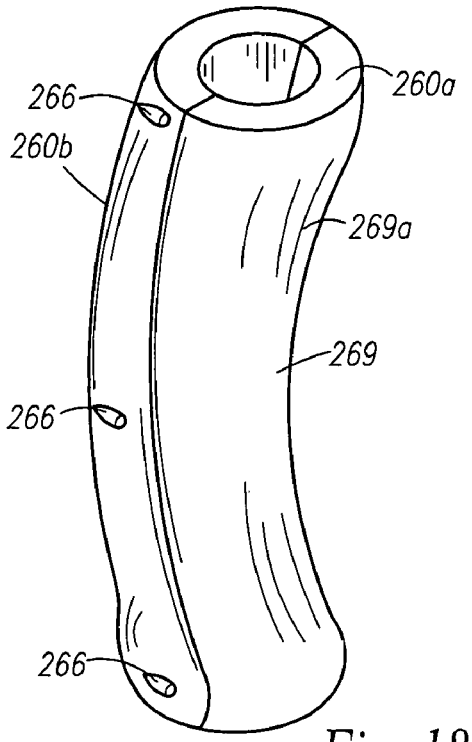
FIG. 18 is a perspective view of an alternate hand grip formed of two halves.

Referring now to FIG. 18, alternatively, hand grip 260 may be formed of two halves 260*a*, 260*b* which are fastened together by fasteners 266 or any other suitable coupling means in a manner so as to effectively encase annular members 276, retaining rings 272 and shaft 240. In this embodiment, the two halves 260*a*, 260*b* are constructed of a rigid material 268 including metallic or metallic-plastic composite or wood. Hand grip half 260*a* is adapted with a contoured rear portion 269 defining a palm recess 269*a*.

Referring now to FIGS. 14-17, and 19, similar to the preferred embodiment, the antifriction rotation assembly 270 of the alternate embodiment is provided with a locking mechanism 280 adapted to quickly lock the rotatable handle grip 260 in a fixed position once archer has the bowstring in a fully drawn position and taken aim. The locking mechanism 280 is further adapted to be quickly released from a locked position. A depressible, spring-biased button 282, extending outwardly from bracket 251 and located proximal to hand grip 260, controls actuation of locking and release functions of locking mechanism 280. A pin and retainer assembly 284 mechanically connects button 282 to antifriction rotation assembly 270 in a manner so as to instantly lock antifriction rotation assembly 270 in a selectively-desired, rotary position upon depression of button 282. Button 282 is further adapted to instantly release annular members 276 from a locked position upon a subsequent depression of button 282.

Figure 21:
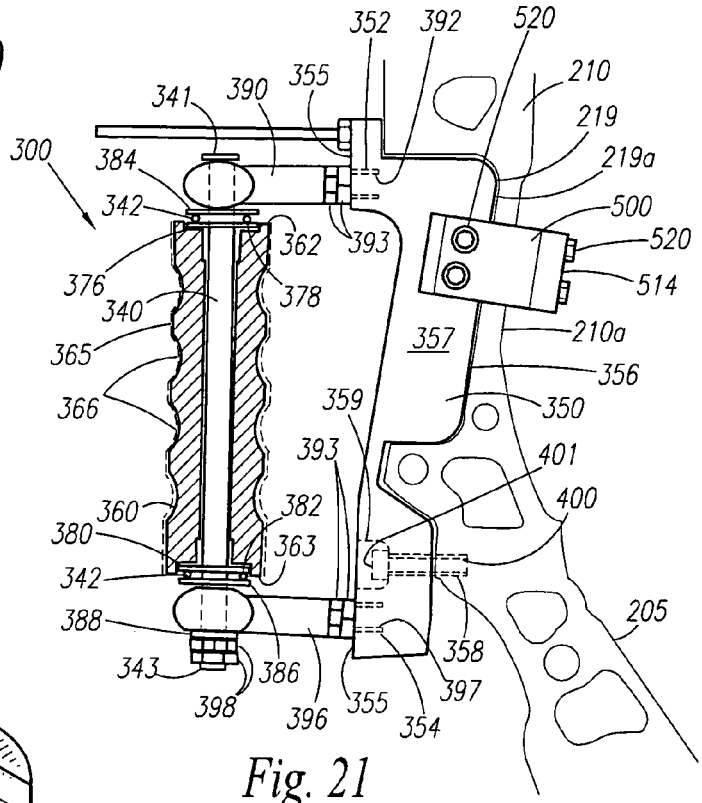
FIG. 21 is a partial, right side elevational view of a second alternate embodiment illustrating a hunting bow shown with a rotatable grip assembly removably attached thereto as an aftermarket accessory.
Figure 22:
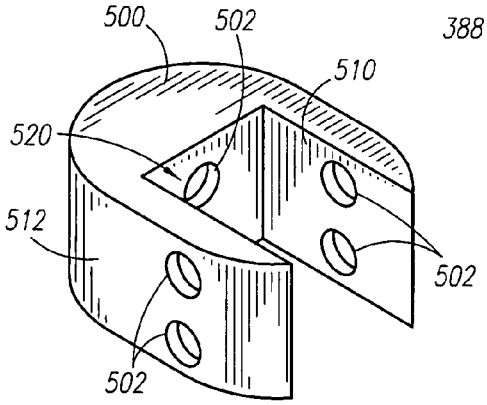
FIG. 22 is a perspective view of the C-shaped mounting bracket, according to the second alternate embodiment of the present invention.

Referring now to FIGS. 21-22, in accordance with another embodiment, a rotatable grip assembly 300 comprises a rigid shaft 340 defining an upper end having a head 341 opposing a threaded lower end 343. A primary mounting bracket 350 is provided for securely affixing shaft 340 to riser 210. In this particular embodiment, the handle grip section 211 of a selected archery bow 205 is removed and is replaced by primary mounting bracket 350.

The shaft 340 is adapted to be mounted directly rearward to the primary mounting bracket 350 so as to reside at an angular orientation with respect thereto as illustrated in FIG. 21.

Rotatable grip assembly 300 includes a hand grip 360 which is rotatably mounted to shaft 340. The hand grip 360 is adapted to rotate in a friction-free manner about a longitudinal axis of shaft 340. The rotatable grip assembly 300 is mounted in such a manner that the hand grip 360 component thereof resides rearward to and at an angular orientation with respect to the primary mounting bracket 350. The primary mounting bracket 350 is mounted to the handle mount area 219 of riser 210. The handle mount area 219 is defined as that area of riser 210 to which handle grip section 211 is typically molded integral or mounted. Rotatable grip assembly 300 is adapted to provide user with a greater draw length (approximately 3 inches) from which a greater arrow-propulsion force is produced, and hence translating into an increase in arrow speed by approximately 35-45 feet per second. Consequently, greater arrow speed also generates greater arrow flight distance. The hand grip 360 will be further described later in greater detail.

In order to facilitate friction-free rotation by hand grip 360 about a longitudinal axis of shaft 340, bearings 342 are disposed along an upper end 362 and a lower end 363 of hand grip 360. The bearings 342 disposed along the upper end 362 of hand grip 360 are housed within a groove 378 formed in a first annular member 376. The bearings 342 disposed along the lower end 363 of hand grip 360 are housed within a groove 382 formed in a second annular member 380. An upper flange 384 sits atop first annular member 376 and a lower flange 386 sits below second annular member 380. The bearings 342 of first annular member 376 bear simultaneously against an upper end 362 or surface of hand grip 360 and upper flange 384. The bearings 342 of second annular member 376 bear simultaneously against a lower end 363 or surface of hand grip 360 and lower flange 386, thereby facilitating frictionless rotation by hand grip 360 between upper flange 384 and lower flange 386.

A first auxiliary bracket 390 is mounted between the head 341 of rigid shaft 340 and the upper flange 384. A second auxiliary bracket 396 is mounted between the lower flange 386 and a base flange 388 which rests atop coupling elements 398 or bolts which are tightened around threaded lower end 343 of shaft 340. First and second auxiliary brackets 390, 396 are adapted to securably mount shaft 340 to the primary mounting bracket 350. The first auxiliary bracket 390 includes a threaded stem 392 projecting therefrom which is threadedly received within a threaded aperture 352 defined through an inner, rear sidewall 355 of primary mounting bracket 350 along an upper portion thereof. The first auxiliary bracket 390 is securably mounted to primary mounting bracket 350 via coupling elements 393 or bolts tightened around threaded stem 392. The second auxiliary bracket 396 includes a threaded stem 397 projecting therefrom which is threadedly received within a threaded aperture 354 defined through the inner, rear sidewall 355 of primary mounting bracket 350 along a lower portion thereof. The second auxiliary bracket 396 is securably mounted to primary mounting bracket 350 via coupling elements 393 or bolts tightened around threaded stem 397.

The primary mounting bracket 350 defines an elongated configuration constructed of a rigid material such as metal. The primary mounting bracket 350 defines a front sidewall 356 opposing a rear sidewall 355 and opposing lateral walls 357. The front sidewall 356 defines an outer contour designed and configured to mate with a contour 219*a* defining the handle mount area 219 of riser 210. Thus, primary mounting bracket 350 is sizably adapted, shaped and configured to conform to and fit snugly against the contour 219*a* of handle mount area 219.

In order to securely mount primary mounting bracket 350 to riser 210, a threaded fastener 400 is advanced through a mesial threaded aperture 358 defined through the inner, rear sidewall 355 of primary mounting bracket 350 along a lower portion thereof, above threaded aperture 354, and advanced further through a threaded aperture 210*c* defined in riser 210. An enlarged circular recess 359 is provided at entrance of mesial threaded aperture 358 in order to accommodate the head 401 of threaded fastener 400. In addition, a generally C-shaped mounting bracket 500 is provided which includes a plurality of spatially-aligned threaded apertures 502. The threaded apertures 502 are defined through an upper sidewall 510, a lower sidewall 512, and a rear sidewall 514 of C-shaped mounting bracket 500. The C-shaped mounting bracket 500 includes a primary bracket receiving recess 520 within which the front sidewall 210*a* of riser 210 and the opposing lateral walls 357 of primary mounting bracket 350 engage. Threaded fasteners 520 are advanced through threaded apertures 502 of C-shaped mounting bracket 500, thereby securing primary mounting bracket 350 to riser 210 via mechanical interference.

The hand grip 360 includes a plurality of integrally-molded finger gripping channels 366 to facilitate grip. The hand grip 360 may be enveloped about the external circumferential surface thereof with a sufficiently flexible, shape-memory material 365 adapted to resume its original shape if compressed. Suitable fabrication materials 365 include a flexible, pliable plastic, rubber or elastomer, silicon, silicon rubber or siliconised polymer, or plastic polymer. More specifically, fabrication materials include neoprene, polyvinyl chloride, thermosensitive siliconised polyvinyl chloride, polyurethane, polyethylene, and polyethylene terephthalate. The enveloped hand grip 360 is adapted to prevent heeling and toeing of the bow when archer aims and shoots an arrow at a desired target. More specifically, the counterproductive pressure exertions applied by an archer resulting in the "heeling" or "toeing" effect are absorbed or consumed by hand grip's 360 pliable composition in a manner so as to maintain bow's proper vertical alignment about the bow midpoint when aiming and shooting an arrow.

Referring now to FIGS. 14-20, the rotatable grip assembly 200, as defined by the first alternate embodiment, is envisioned to be commercially available and sold as an aftermarket accessory for commercially-available archery bows 205. The rotatable grip assembly 200, as an aftermarket accessory, is intended to be sold as a kit 288, wherein kit 288 comprises a package 290 for housing at least one pair of mounting brackets 250, an antifriction rotation assembly 270, a hand grip 260, an instruction leaflet 292, a plurality of fasteners 256, and other components as may be required including but not limited to clips, washers, bolts, anchors, and adhesive. The kit 288 provides consumers with an aftermarket, add-on accessory for archery bows 205, wherein aftermarket accessory is more specifically defined as a rotatable grip assembly 200 adapted for removable attachment to an archery bow 205 or hunting bow.

Further in accordance with the first alternate embodiment of the present invention, a method is provided for mounting the rotatable grip assembly 200 to an archery bow 205 or hunting bow, wherein the method comprises the steps of drilling apertures through a front side wall and rear side wall of riser 210, removing the pair of mounting brackets 250 with attached hand grip 260 from the package 290, and securing first and second mounting bracket 251, 254 to riser 210 by fasteners 256.

Figure 23:
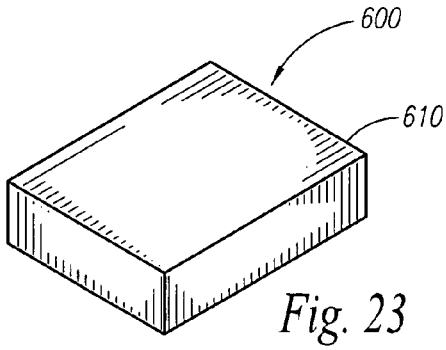
FIG. 23 a perspective view of a kit, according to the second alternate embodiment of the present invention.

Referring now to FIGS. 21-23, the rotatable grip assembly 300, as defined by the second alternate embodiment, is envisioned to be commercially available and sold as an aftermarket accessory for commercially-available archery bows 205. The rotatable grip assembly 300, as an aftermarket accessory, is intended to be sold as a kit 600, wherein kit 600 comprises a package 610 for housing a first auxiliary bracket 390, a second auxiliary bracket 396, a primary mounting bracket 350, at least one threaded fastener 520, a plurality of threaded fasteners 400, a first annular member 376 with bearings 342 housed therein, a second annular member 380 with bearings 342 housed therein, an upper flange 384, a lower flange 386, a base flange 388, a plurality of coupling elements 393, a rigid shaft 340, a hand grip 360, an instruction leaflet 292, a plurality of coupling elements 398, and other components as may be required including but not limited to clips, washers, bolts, anchors, and adhesive. The kit 600 provides consumers with an aftermarket, add-on accessory for archery bows 205, wherein aftermarket accessory is more specifically defined as a rotatable grip assembly 300 adapted for removable attachment to an archery bow 205 or hunting bow.

Further in accordance with the second alternate embodiment of the present invention, a method is provided for mounting the rotatable grip assembly 300 to an archery bow 205 or hunting bow, wherein the method comprises the steps of placing the primary mounting bracket 350 with attached hand grip 360 snugly against the contour 219*a* of the handle mount area 219 of riser 210, advancing threaded fastener 400 through the mesial threaded aperture 358 defined through the inner, rear sidewall 355 of primary mounting bracket 350 along a lower portion thereof and further advancing threaded fastener 400 through threaded aperture 210*c* defined in riser 210 until tight, placing the C-shaped mounting bracket 500 over both the front sidewall 210*a* of riser 210 and the opposing lateral walls 357 of primary mounting bracket 350, and advancing threaded fasteners 520 through threaded apertures 502 of C-shaped mounting bracket 500 in a manner such that primary mounting bracket 350 is fixedly secured to riser 210 via mechanical interference.

2. Operation of the Preferred Embodiment

To use the present invention, user grasps rotatable hand grip 40 inside the palm of user's chosen hand for bracing purposes, and inserts bowstring 28 within the slit of the nock of an arrow. User next draws back arrow by pulling nock rearward while simultaneously resting arrow shaft on the arrow rest component. After taking careful aim at a desired target, user releases arrow.

The use of the present invention allows an archer to eliminate heeling, toeing, and torquing of an archery bow when aiming and shooting an arrow in a manner which is quick, easy, and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A grin assembly comprising:

a rotatable grip assembly adapted for removable attachment to archery bows as an aftermarket accessory, said rotatable grip assembly comprising:

a rigid shaft, said rigid shaft defines an upper end opposing lower end;

a pair of mounting brackets, said pair of mounting brackets is mounted or integrally molded to said rigid shaft, said pair of mounting brackets are adapted tot securely affixing said rigid shaft to a bow riser, wherein said pair of mounting brackets includes a first mounting bracket and a second mounting bracket said first mounting bracket having a generally L-shaped configuration and an integral riser abutment shoulder, said first mounting bracket is mounted or molded integral to said upper end of said shaft, said first mounting bracket is mounted via fasteners to a front sidewall of the riser, along an upper end and a lower end of the handle grip section thereof, said second mounting bracket having a generally L-shaped configuration, said second mounting bracket is mounted or molded integral to said lower end of said shaft, said second mounting bracket is mounted via fastener to a rear sidewall of the riser, below the handle grip section thereof, and wherein said first mounting bracket and said second mounting bracket are securably mounted to a riser of an archery bow by fasteners in such a manner at said shaft is mounted directly rearward to a handle grip section of the riser, thereby allowing said shaft to reside in parallel alignment and in a same geometric longitudinal plane with the handle grip section;

a hand grip, said hand grin is rotatably mounted to said rigid shaft, said hand grip is adapted to rotate in a friction-free manner about a longitudinal axis of said rigid shaft, wherein said hand grip is rotatably mounted to said shaft in a position being posterior to the handle grip section of the archery bow, thereby providing user with a greater or extended draw length from which a greater arrow-propulsion force is produced, and hence translating into an increase in arrow speed by approximately 35 to 45 feet per second; and an antifriction rotation assembly, said antifriction rotation assembly allows said hand grip to rotate in a friction-free manner about the longitudinal axis of said shaft.

2. The grip assembly of claim 1, wherein said antifriction rotation assembly comprises a series of retaining rings mounted in spaced, linear relation about an external circumferential surface of said shaft, wherein each retaining ring of said series of retaining rings includes an annular member rotatably disposed about an outer circumferential surface thereof, each said annular member having an annular groove housing a plurality of bearings, each said annular member is rotatably disposed about an outer circumferential surface of a respective retaining ring in a manner whereby said bearings of each said annular member bear against said outer circumferential surface of each said respective retaining ring, thereby facilitating frictionless rotation between each said annular member and each said respective retaining ring, said antifriction rotation assembly is adapted to allow said hand grip to rotate clockwise and counterclockwise in a friction-free manner about said longitudinal axis of said shaft, thereby preventing torque from being applied to the archery bow and resulting in a substantially high degree of bow shooting accuracy.

3. The grip assembly of claim 1, further comprising a locking mechanism, said locking mechanism is adapted to quickly lock said hand grip to a locked position and quickly release said hand grip to an unlocked, free-spinning or rotatable position.

4. A grip assembly comprising:

a rotatable grip assembly adapted for removable attachment to archery bows as an aftermarket accessory, said rotatable grip assembly comprising:

a rigid shaft, said rigid shaft defines an upper end opposing a lower end;

a pair of mounting brackets, said pair of mounting brackets is mounted or integrally molded to said rigid shaft said pair of mounting brackets are adapted for securely affixing said rigid shaft to a bow riser, wherein said pair of mounting brackets includes a first mounting bracket and a second mounting bracket, said first mounting bracket having a generally L-shaped configuration and an integral riser abutment shoulder, said first mounting bracket is mounted or molded integral to said upper end of said shaft said first mounting bracket is mounted via fasteners to a front sidewall at the riser, along an upper end and a lower end of the handle grip section thereof said second mounted bracket having a generally L-shaped configuration, said second mounting bracket is mounted or molded integral to said lower end of said shaft said second mounting bracket is mounted via fastener to a rear sidewall of the riser, below the handle grip section thereof and wherein said first mounting bracket and said second mounting bracket are securably mounted to a riser of an archery bow by fasteners in such a manner that said shaft is mounted directly rearward to a handle grip section of the risen thereby allowing said shaft to reside in parallel alignment and in a same geometric longitudinal plane with the handle grip section;

a hand grip, said band grip is rotatably mounted to said rigid shaft said hand grip is adapted to rotate in a friction-free manner about a longitudinal axis of said rigid shaft, wherein said hand arm is rotatably mounted to said shaft in a position being posterior to the handle arm section of the archery bow, thereby providing user with a greater or extended draw length from which a greater arrow-propulsion force is produced, and hence translating into an increase in arrow speed by approximately 35 to 45 feet per second;

an antifriction rotation assembly, said antifriction rotation assembly allows said hand grip to rotate in a friction-free manner about the longitudinal axis of said shaft; and an alignment means, said alignment means is adapted to allow for selective lateral adjustment of said rotatable grip assembly, thereby facilitating optimum center alignment thereof, said alignment means is defined as a male threaded bolt advanced through a female threaded hole defined through said first mounting bracket along an upper portion thereof, and said male threaded bolt is mechanically engaged against a lateral sidewall of the riser.

5. A handle grip assembly comprising:

a rotatable grip assembly adapted for removable attachment to archery bows as an aftermarket accessory, said rotatable grip assembly comprising:

a rigid shaft, said rigid shaft defining an upper end having a head opposing a threaded lower end;

a primary mounting bracket, said primary mounting bracket is adapted for securely affixing said rigid shaft to a riser of an archery bow;

a hand grip, said hand grip is rotatably mounted to said rigid shaft, said hand grip is adapted to rotate in a friction-free manner about a longitudinal axis of said rigid shaft;

a first auxiliary bracket, said first auxiliary bracket is adapted for mounting an upper end of said rigid shaft to said primary mounting bracket;

a second auxiliary bracket, said second auxiliary bracket is adapted for mounting a lower end of said rigid shaft to said primary mounting bracket; and a C-shaped mounting bracket, said C-shaped mounting bracket is adapted to secure said primary mounting bracket to the riser via mechanical interference.

6. The handle grip assembly of claim 5, wherein said rigid shaft is mounted directly rearward to said primary mounting bracket so as to reside at an angular orientation with respect thereto.

7. The handle grip assembly of claim 5, wherein said hand grip includes bearings disposed along an upper end thereof, said bearings are housed within a groove formed in a first annular member.

8. The handle grip assembly of claim 5, wherein said hand grip includes bearings disposed along a lower end thereof, said bearings are housed within a groove formed in a second annular member.

9. The handle grip assembly of claim 5, further comprising an upper flange and a lower flange, said upper flange sits atop said first annular member, said lower flange sits below said second annular member, said bearings of said first annular member bear simultaneously against said upper end or surface of said hand grip and said upper flange, and wherein said bearings of said second annular member bear simultaneously against said lower end or surface of said hand grip and said lower flange, thereby facilitating frictionless rotation by said hand grip between said upper flange and said lower flange.

10. The handle grip assembly of claim 5, wherein said first auxiliary bracket is mounted between said head of said rigid shaft and said upper flange, said second auxiliary bracket is mounted between said lower flange and a base flange, said base flange rests atop coupling elements which are tightened around said threaded lower end of said shaft.

11. The handle grip assembly of claim 10, wherein said first auxiliary bracket includes a threaded stem projecting therefrom, said threaded stem of said first auxiliary bracket is threadedly received within a threaded aperture defined through an inner, rear sidewall of said primary mounting bracket along an upper portion thereof, said first auxiliary bracket is securably mounted to said primary mounting bracket via coupling elements tightened around said threaded stem of said first auxiliary bracket, and wherein said second auxiliary bracket includes a threaded stem projecting therefrom, said threaded stem of said second auxiliary bracket is threadedly received within a threaded aperture defined through said inner, rear sidewall of said primary mounting bracket along a lower portion thereof, said second auxiliary bracket is securably mounted to said primary mounting bracket via coupling elements tightened around said threaded stem of said second auxiliary bracket.

12. The handle grip assembly of claim 5, wherein said primary mounting bracket defines an elongated configuration constructed of a rigid material, said primary mounting bracket defines a front sidewall opposing a rear sidewall, and opposing lateral walls, said front sidewall defines an outer contour designed and configured to mate with a contour defining a handle mount area of the riser, said primary mounting bracket is sizably adapted, shaped and configured to conform to and fit snugly against the contour of the handle mount area of the riser.

13. The handle grip assembly of claim 12, wherein said primary mounting bracket includes a mesial threaded aperture defined though said rear sidewall of said primary mounting bracket along said lower portion thereof and above said threaded aperture which threadedly receives said threaded stem of said second auxiliary bracket, said mesial threaded aperture is advanced by a threaded fastener therethrough, said threaded fastener is further advanced through a threaded aperture defined in the riser in order to securely mount said primary mounting bracket to said riser.

14. The handle grip assembly of claim 13, wherein said mesial threaded aperture includes an enlarged circular recess provided at an entrance thereof in order to accommodate said head of said threaded fastener.

15. The handle grip assembly of claim 5, wherein said C-shaped mounting bracket defines an upper sidewall, a lower sidewall, and a rear sidewall, said C-shaped mounting bracket includes a plurality of spatially-aligned threaded apertures, said spatially-aligned threaded apertures are defined through said upper sidewall, said lower sidewall, and said rear sidewall of said C-shaped mounting bracket.

16. The handle grip assembly of claim 15, wherein said C-shaped mounting bracket includes a primary bracket receiving recess within which the front sidewall of the riser and said opposing lateral walls of said primary mounting bracket engage, said spatially-aligned threaded apertures are threadedly advanced by threaded fasteners, thereby securing said primary mounting bracket to the riser via mechanical interference.

17. The handle grip assembly of claim 5, wherein said hand grip includes a plurality of finger gripping channels molded integral therein in order to facilitate grip.

18. The handle grip assembly of claim 17, wherein said hand grip is enveloped about an external circumferential surface thereof with a sufficiently flexible, shape-memory material adapted to resume its original shape upon compression thereof.

* * * * *